US005887681A

United States Patent [19]

Bondavalli

[11] Patent Number: 5,887,681

[45] Date of Patent: Mar. 30, 1999

[54] MULTIFUNCTION CONNECTION AND SUPPORT ELEMENT IN A MECHANISM FOR AUTOMATIC DOOR MOTION FOR LIFTS AND ELEVATORS

[75] Inventor: Rolando Bondavalli, Brescello, Italy

[73] Assignee: Inventio AG, Hergiswil, Switzerland

[21] Appl. No.: 750,543

[22] PCT Filed: Oct. 5, 1994

[86] PCT No.: PCT/IT94/00164

§ 371 Date: Jan. 21, 1997

§ 102(e) Date: Jan. 21, 1997

[87] PCT Pub. No.: WO95/32912

PCT Pub. Date: Dec. 7, 1995

[30] Foreign Application Priority Data

May 31, 1994 [IT] Italy ..... PR940008 U

[51] Int. Cl.[6] ..... B66B 13/06

[52] U.S. Cl. ..... 187/333; 187/334; 187/325; 49/120

[58] Field of Search ..... 187/333, 334, 187/325; 49/116, 120

[56] References Cited

U.S. PATENT DOCUMENTS

| | | | |
|---|---|---|---|
| 3,426,480 | 2/1969 | Dzamba | 187/333 |
| 3,535,837 | 10/1970 | Atkinson et al. | 187/313 |
| 4,099,599 | 7/1978 | Randall | 187/313 |
| 4,205,486 | 6/1980 | Guarnacci . | |
| 5,165,505 | 11/1992 | Hayashi et al. | 187/333 |
| 5,174,675 | 12/1992 | Martin | 187/334 |
| 5,265,702 | 11/1993 | Garrido et al. | 187/334 |
| 5,445,244 | 8/1995 | Ketonen | 187/325 |
| 5,673,770 | 10/1997 | Friedman | 187/333 |

FOREIGN PATENT DOCUMENTS

| | | | |
|---|---|---|---|
| 3-211185 | 9/1991 | Japan | 187/313 |
| 6-32571 | 2/1994 | Japan | 187/334 |
| 6-48674 | 2/1994 | Japan | 187/313 |

*Primary Examiner*—Dean Kramer
*Assistant Examiner*—Douglas Hess
*Attorney, Agent, or Firm*—MacMillan, Sobanski, & Todd, LLC

[57] ABSTRACT

The invention relates to a multifunction connection and support element for an elevator door structure. The element includes, for each lateral jamb, a connection and support bracket that connects and unites each jamb with an architrave and also to an anchor bracket to be fixed to an elevator shaft wall. The anchor bracket also functions as a guide for sliding carriages of a door motion mechanism. The connection and support bracket performs all functions that in the past were carried out by several distinct connection and support elements.

12 Claims, 2 Drawing Sheets

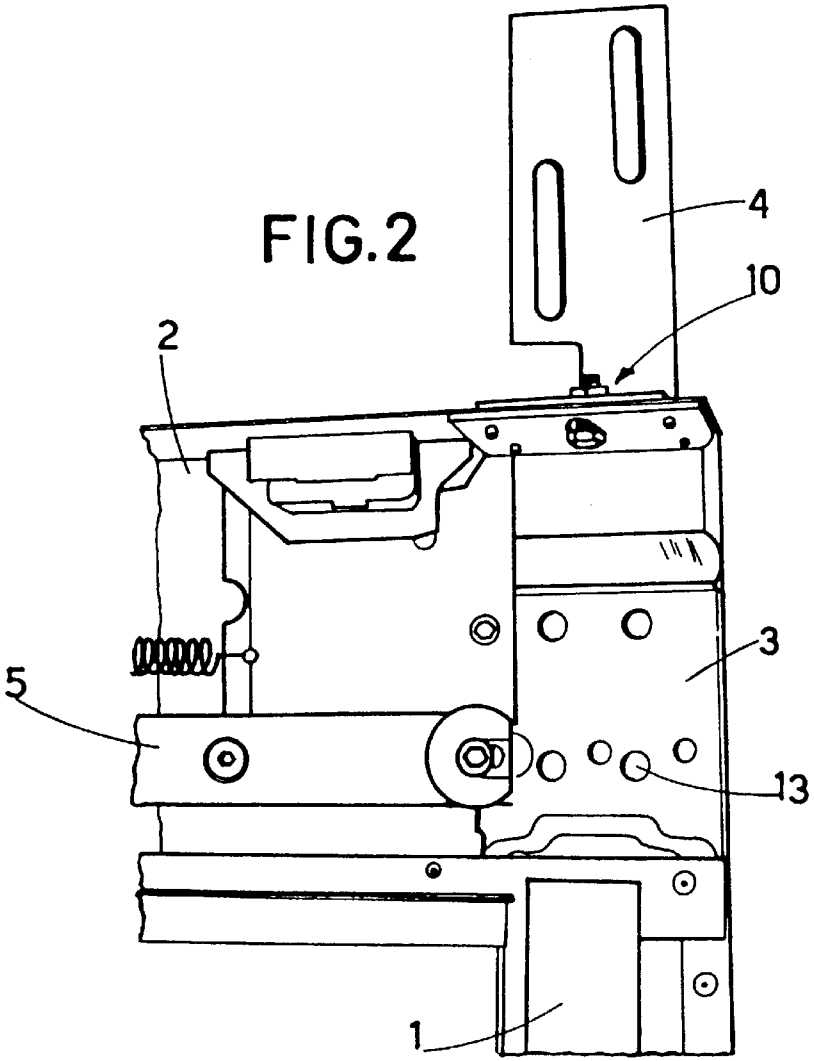
FIG.2
FIG.1
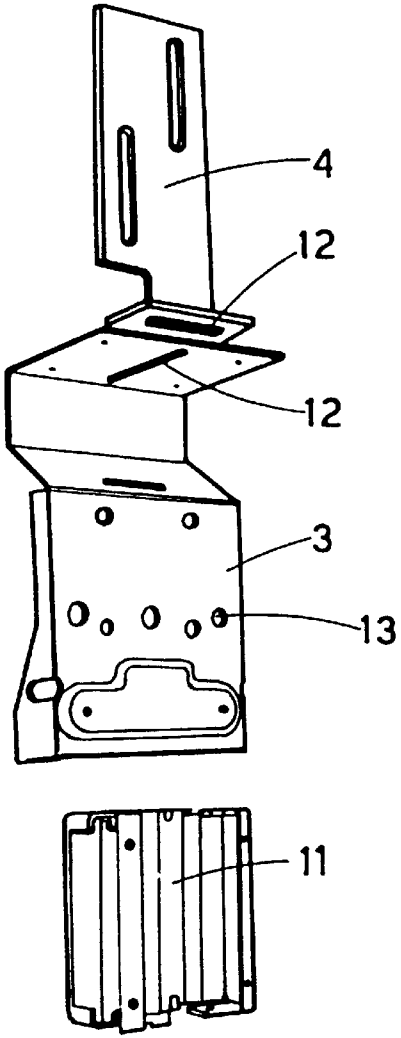

MULTIFUNCTION CONNECTION AND SUPPORT ELEMENT IN A MECHANISM FOR AUTOMATIC DOOR MOTION FOR LIFTS AND ELEVATORS

The invention relates to a multifunction, connection and support element in a mechanism for automatic door motion for lifts and elevators. Known-type lifts generally comprise two lateral jambs and a transversal superior element, or architrave, which connects the two jambs (for example by bolting) and houses the motion mechanism of the lift doors.

The architrave is provided with means for anchoring to a fixed wall of the lift shaft, which means for anchoring are constituted by brackets bolted to the architrave in the central zone thereof and fixed to the wall by screws.

Internally of the architrave there are also supports for the guides of the door motion mechanisms, which supports are completely separate from the above-mentioned screws and are not applied thereat.

The principal drawback of the above realizations is the need to arrange a large number of connection or support elements for fixing the various components of the door and for the support of the guides of the movement carriages of the doors.

A further drawback is that the numerous connection and support elements are positioned rather distributedly along the architrave, which can lead to slight bending thereof.

The main aim of the present invention is to obviate the above drawbacks by providing a multifunction connection and support element able efficiently to perform the functions of numerous elements employed in the prior art, and also able better to stiffen and strengthen the door structure.

The above aims are fully attained by the multifunction connection and support element, object of the present invention, which is characterized as set out in the accompanying claims and in particular in that it consists of a connection and support bracket for each lateral door jamb, which contemporaneously connects and unites the jamb with the architrave as well as with the means for anchoring the architrave to a fixed wall.

The bracket preferably also supports the sliding guides of the door motion carriages.

Further characteristics and advantages of the present invention will better emerge from the detailed description that follows, of an embodiment of the invention, illustrated in the form of a non-limiting example in the accompanying drawings, in which:

FIG. 1 shows the multifunction element in an exploded perspective view;

FIG. 2 shows the multifunction element in place, in a frontal perspective view;

With reference to the figures, 1 denotes the side jambs of a gate having automatic doors 7, in particular used for lifts and elevators. The doors 7 can be of the centre-to-side opening type, or of the telescopic type, with segments telescoping either to the right or the left.

Figure 3:
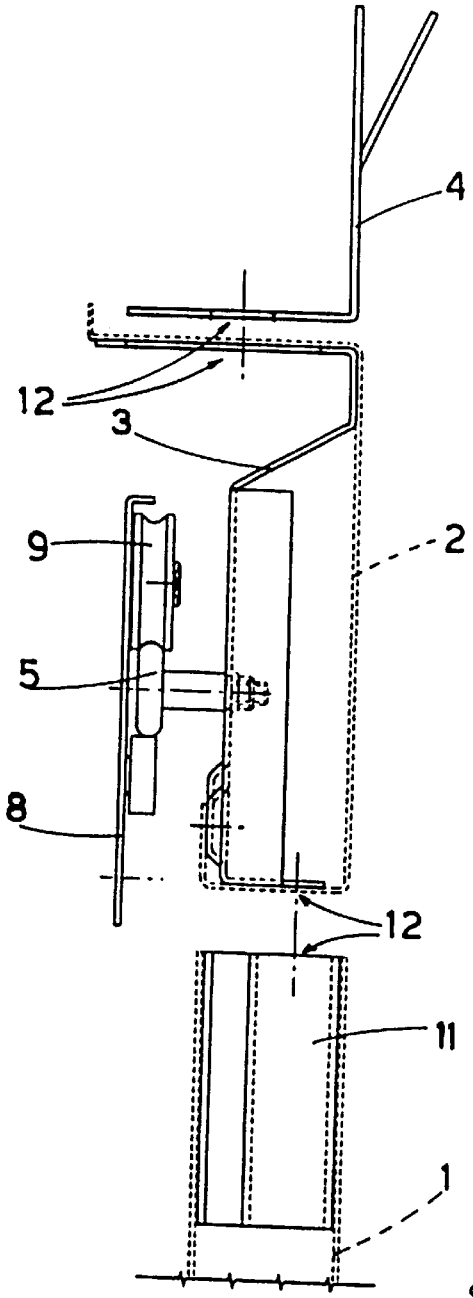
FIG. 3 shows the element in a lateral view.

The means for moving the doors, of known type, are housed internally to an architrave 2 which connects the two jambs 1. The means for moving the doors usually comprise door support carriages (one of which is schematically denoted by 8 in FIG. 3), which slide by means of rollers 9 on guides 5. A multifunction connection and support element is housed in the architrave 2, which element is constituted by a bracket 3 connecting the jamb 1 with the architrave 2, and the architrave 2 with a second bracket 4 constituting a means for anchoring the jamb 2 to a wall, not illustrated, in the lift shaft.

The bracket 3 also functions as a support for the guide 5 of the door motion mechanism carriage. At least two brackets 3 are present, one positioned at each jamb, and further intermediate brackets can be applied if necessary, along the architrave 2, to afford further support to the guide 5.

It is clear how having provided a multifunction bracket 3 and its positioning such as to create a continuous arrangement among the various components of the door structure (jamb 1, architrave 2, second bracket 4) help to obtain greater rigidity and a strengthening of the whole structure with respect to prior art realizations. The bracket 3 is fixed to the jamb 1 and the second bracket 4 by means for fixing of known type, for example bolts 10. The bracket is also provided with a plurality of slots 12 for the insertion of the fixing means. Similarly, slots are also provided in the jamb 1 and the second bracket 4.

The front part of the bracket 3 is further provided with a plurality of apertures 13 in which the means for fixing the guides 5 are inserted. In the upper part of the jamb 1 a connector 11 can be inserted, for further stiffening the structure by creating a sort of internal reinforcement in the jamb.

Figure 4:
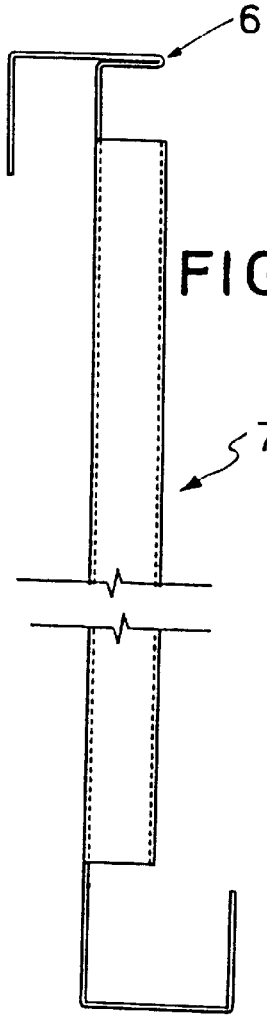
FIG. 4 is a transversal section of the profile of a door.
Figure 5:
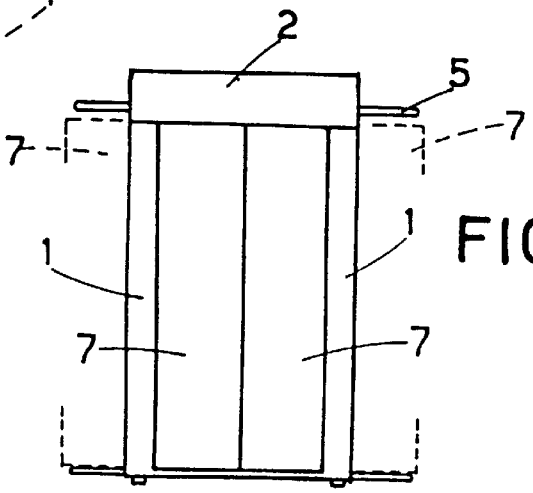
FIG. 5 is a schematic view of a lift gate with an automatic door.

With reference in particular to FIG. 4, a door 7 is illustrated which is provided with a reinforcement rib 6 extending over the whole height of the door, and having the function of stiffening the door itself, and in particular the opening side of the door so that it will not be susceptible to bending.

The bracket and the connector 11 are preferably made in metal.

I claim:

1. A multifunction connection and support element in a mechanism for automatic door motion for elevators, comprising two lateral jambs (1) and an architrave (2) which connects the two jambs and which houses motion mechanisms of doors (7) of an elevator, said architrave (2) being constrained by anchoring means (4) to a fixed wall in an elevator shaft in which the elevator moves up and down, wherein the multifunction connection and support element consists of, for each lateral jamb, a connection and support bracket (3) which connects and unites the jamb (1) with the architrave (2) and the anchoring means (4).

2. An element as in claim 1, wherein the connection and support bracket (3) supports at least one guide (5) of movement carriages (8) of the doors (7).

3. An element as in claim 1, wherein the bracket (3) is provided with at least one slot (12, 13) for an insertion of means (10) for fixing the jamb (1), the architrave (2) and the guide (5) and the anchoring means (4) all together.

4. An element as in claim 1, characterised in that the connection with the jamb (1) employs a connector (11) which snugly inserts into and reinforces the jamb (1).

5. An automatic door apparatus for use with an elevator door opening in a wall of an elevator shaft comprising:

a pair of laterally spaced jambs (1) for positioning at opposite sides of a door opening in a wall of an elevator shaft;

an architrave (2) for coupling upper ends of said jambs (1);

a means for moving (8) housed in said architrave (2) for operating at least one elevator door;

an elevator door (7) mounted for movement in the door opening and connected to said means for moving (8);

an anchoring means (4) for coupling to said architrave (2) and for attachment to the wall of the elevator shaft at the door opening; and at least a pair of connection and support brackets (3) attached to and coupling said jambs (1) with said architrave (2) and said anchoring means (4).

6. The apparatus according to claim 5 including a connector (11) inserted in said upper end of said jamb (1) for reinforcing said jamb.

7. The apparatus according to claim 5 wherein said door (7) includes a generally vertically extending reinforcing rib (6) formed at an opening side edge of a said door.

8. The apparatus according to claim 5 wherein said connection and support brackets (3) support a guide (5) on which a door support carriage (8) of said means for moving moves.

9. The apparatus according to claim 8 wherein said connection and support bracket (3) has formed therein a plurality of apertures (13) for receiving and retaining said guide (5).

10. The apparatus according to claim 8 including at least one roller (9) rotatably attached to said door support carriage (8) for contacting said guide (5).

11. The apparatus according to claim 5 wherein each said connection and support bracket (3) and said anchoring means (4) have formed therein a pair of transversely extending slots (12) for receiving a means for fixing (10) to attach said connection and support bracket (3) to said architrave (2) and to said anchoring means (4).

12. The apparatus according to claim 11 wherein said means for fixing is a bolt (10).

* * * * *